US007290574B2

(12) United States Patent
Baber

(10) Patent No.: US 7,290,574 B2
(45) Date of Patent: Nov. 6, 2007

(54) POWER TOOL SUPPORT FIXTURE

(75) Inventor: Brad M. Baber, Arlington Heights, IL (US)

(73) Assignee: Credo Technology Corporation, Broadview, IL (US)

( * ) Notice: Subject to any disclaimer, the term of this patent is extended or adjusted under 35 U.S.C. 154(b) by 318 days.

(21) Appl. No.: 10/680,513

(22) Filed: Oct. 7, 2003

(65) Prior Publication Data

US 2005/0072490 A1 Apr. 7, 2005

(51) Int. Cl.
*B27C 5/00* (2006.01)
*B27M 3/00* (2006.01)

(52) U.S. Cl. ..... 144/135.2; 144/136.95; 144/48.5; 144/48.6; 409/182; 409/180

(58) Field of Classification Search ..... 144/134.1, 144/135.2, 135.3, 136.95, 154.5, 48.5, 48.6; 409/182, 180, 181
See application file for complete search history.

(56) References Cited

U.S. PATENT DOCUMENTS 3,162,221 A 12/1964 Lacey
3,312,258 A 4/1967 Spampinato
3,447,001 A * 5/1969 Zelik ..... 310/50
3,767,948 A * 10/1973 Batson ..... 310/50
3,811,361 A * 5/1974 Seely et al. ..... 409/182
3,874,810 A * 4/1975 Russell ..... 408/14
3,958,893 A 5/1976 Boyajian
4,102,370 A 7/1978 Vess
4,179,231 A * 12/1979 Hadden ..... 408/112
4,445,811 A * 5/1984 Sanders ..... 409/182
5,671,789 A * 9/1997 Stolzer et al. ..... 144/154.5
6,042,310 A * 3/2000 Campbell et al. ..... 409/131
6,224,304 B1 * 5/2001 Smith et al. ..... 409/182
6,244,796 B1 6/2001 Schuebel et al.

* cited by examiner

*Primary Examiner*—Bena Miller
(74) *Attorney, Agent, or Firm*—Maginot, Moore & Beck

(57) ABSTRACT

A support fixture for a hand-held power tool includes a base plate and a guide plate assembly supported for movement relative to the base plate to bring the working end of the power tool into contact with a workpiece on which the base plate is supported. The guide plate assembly includes a tool support housing configured for supporting the body of the power tool, and an overthrow nut assembly for threaded engagement with a threaded portion of the power tool adjacent the working end of the tool. The fixture includes a guide bushing that is top-loaded into a bushing collar defined in the base plate, in which the guide bushing is configured to engage a template supported on the workpiece. A threaded plug holds the guide bushing within the bushing collar.

22 Claims, 8 Drawing Sheets

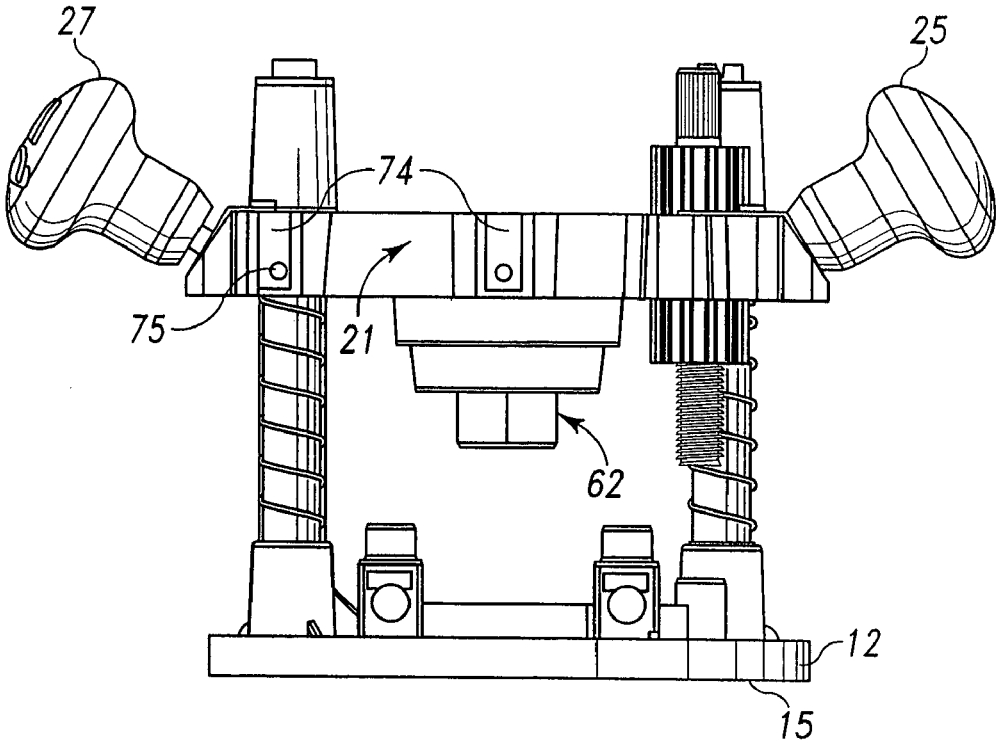
Fig. 5
Fig. 6
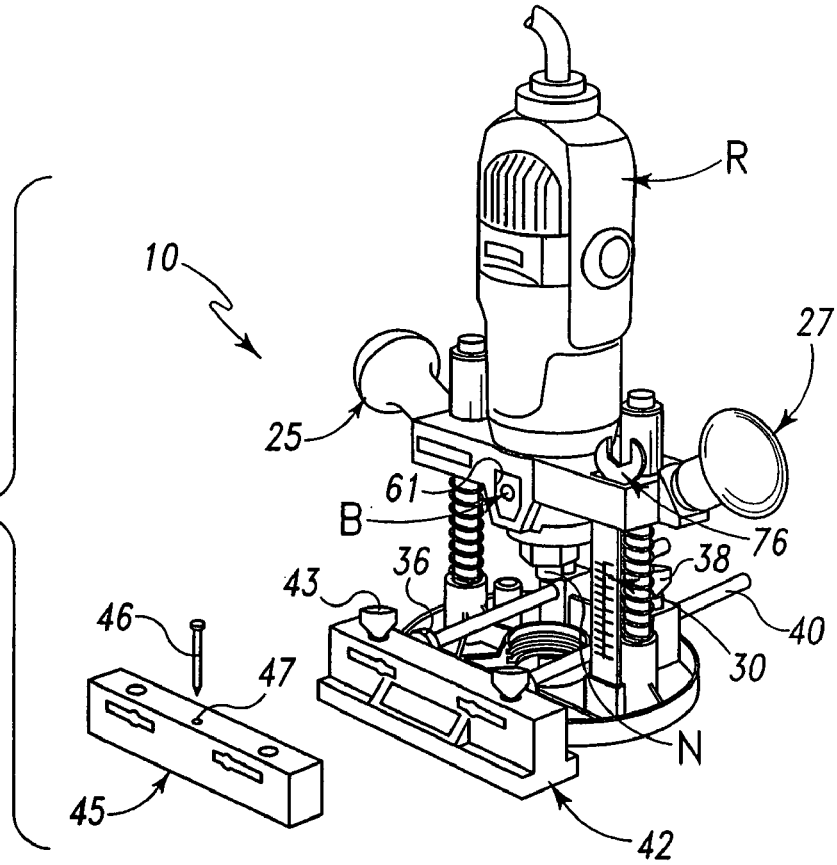

POWER TOOL SUPPORT FIXTURE

BACKGROUND OF THE INVENTION

The present invention relates to hand-held power tools, and particularly to a support fixture for such tools.

Hand-held power tools have been used by woodworkers for many decades. From the day that the power drill replaced the brace and bit, hand-held tools have greatly simplified most woodworking projects and, perhaps most significantly, made woodworking and carpentry within the grasp of the non-professional. Throughout its development, the power drill has been adapted to a variety of woodworking and carpentry tasks, nearly all predicated on replacing the drill bit with a specialized tool. For instance, special bits have been developed for creating different types of holes in a workpiece. Other attachments allow a power drill to act as a screwdriver or sander. Still other attachment bits convert the power drill to a router capable of producing intricate patterns and scrollwork in a workpiece.

Woodworking power tools have evolved from the bulky pistol grip type drill to a more compact, "pencil" type tool. Smaller hand-held tools are available for performing very intricate cuts in a workpiece. Other hand-held power tools and attachments have been developed to allow a held-held drill to function like a coping saw or jig saw. To assist in these functions, templates are frequently provided to guide the woodworker. Initially, a steady hand was the only hope for the woodworker to follow the template, especially when making intricate cuts.

Eventually, attachments were developed that supported the hand-tool and provided a surface for supporting the tool on the workpiece. For instance, U.S. Pat. No. 3,162,221 to Lacey discloses a router attachment that attaches to the working end of a pistol grip drill by way of a split clamp. This attachment freed the woodworker form having to deftly maneuver the bulky drill to perform router operations. The attachment included hand grips on opposite sides of a base plate that interface with the surface of the workpiece. The hand grips allowed the operator to use both hands in a very efficient and effective manner to guide the drill and router bit along the workpiece. While the attachment in the '221 Patent maintained the router bit in a fixed vertical position, the router attachment in U.S. Pat. No. 4,102,370 to Vess provided a means for supporting the router bit above the workpiece until it a cut is made. The system of the '370 Patent allowed the base of the attachment to remain in contact with the workpiece, even when a cut is not being made.

Many routing cuts are made with a pattern or template. Templates can be used to create finger joints, as disclosed in U.S. Pat. No. 5,584,328 to Grisley, to perform edge cuts, as shown in U.S. Pat. No. 5,685,675 to Beekman, or to create intricate patterns in a workpiece. Of course, the quality of the cut using a template is only as good as the ability of the operator to accurately follow the template. The '328 and '675 Patents disclose guide elements that engage and follow the template contour, all the while maintaining the router bit centered with the pattern.

All of these advances have simplified what had once been difficult and time-consuming woodworking tasks. As more and more people become "do-it yourselfers", the hand-held power tools need to become easier for the operator to manipulate to make accurate and clean cuts.

SUMMARY OF THE INVENTION

In one aspect of the invention, a fixture for supporting a hand-held power tool on a workpiece is provided with a base plate for contacting the workpiece, in which the base plate defines an opening for passage of the tool bit therethrough to contact the workpiece. The fixture includes a guide plate supported on the base plate for movement relative to the base plate, and a tool support housing associated with the guide plate. The tool support housing includes a housing body configured to receive the power tool body therein, and defining a tool bore for extension of a portion of the power tool body adjacent the drive spindle therethrough.

A clamping mechanism is provided for fixing the portion of the power tool within the tool support housing, which includes an engagement member supported on the guide plate between the housing body and the guide plate. The engagement member is operable to engage the portion of the power tool body adjacent the drive spindle. The engagement member also defines a bore for extension of the tool bit therethrough. With this tool support housing and clamping mechanism, the power tool is supported at its working end and can be readily engaged to the fixture.

In one aspect of the invention, the tool support housing defines an access window that is arranged to permit access to the spindle locking button of the power tool when the power tool is fixed within the tool support housing. This access opening allows a user to remove and replace the tool bit of the power tool when the tool is still supported by the fixture.

In a preferred embodiment, the engagement member includes an overthrow nut having internal threads for threaded engagement with the threaded portion of the power tool body adjacent the drive spindle. The overthrow nut is supported on the guide plate so that the nut can be rotated manually form underneath the guide plate. This configuration further facilitates the engagement of the power tool to the fixture.

In another aspect of the invention, a tool support housing is provided for supporting a hand-held power tool on a fixture. The support housing comprises a housing body configured to receive the power tool body therein, in which the housing body defines a tool bore for extension of a portion of the power tool body adjacent the drive spindle therethrough. The support housing further includes a clamping mechanism for fixing the portion of the power tool within the tool support housing, which includes an engagement member supported on the guide plate between the housing body and the guide plate. The engagement member is operable to engage the portion of the power tool body adjacent the working end of the tool, and further defines a bore for extension of the tool bit therethrough.

With this embodiment, the tool support housing further comprises means for attaching the housing body to the fixture. Thus, the tool support housing can be mounted to an existing drill press, or can be integrated into a guide plate assembly for a tool support fixture.

It is one object of the invention to provide a fixture for supporting a hand-held power tool on a workpiece. It is a further object to provide the fixture with a mechanism permitting ready and simple engagement of the power tool to the fixture.

DESCRIPTION OF THE FIGURES

FIG. 5 is a back elevational view of the power tool support fixture shown in FIG. 1.

FIG. 6 is a front perspective view of the power tool support fixture of FIG. 1 together with interchangeable guide components, shown with a hand-held power tool supported by the fixture.

DESCRIPTION OF THE PREFERRED EMBODIMENTS

Figure 1:
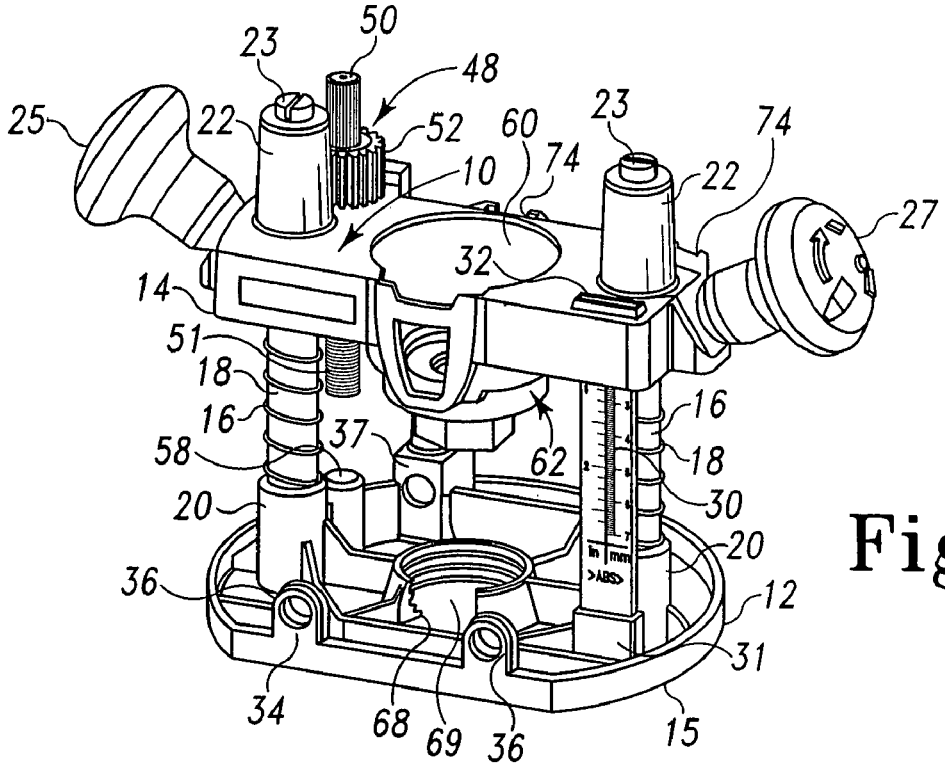
FIG. 1 is a front perspective view of a hand-held power tool support fixture according to one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

In accordance with one embodiment of the invention, a plunge router support fixture 10 is depicted in FIGS. 1-7. The support fixture 10 includes a base plate 12 that includes a bottom surface 15 that supports the support fixture on a workpiece and/or template mounted on the workpiece. A guide plate assembly 14 is supported vertically offset from the base plate 12 by a pair of guide posts 16. Return springs 18 are concentrically disposed about each guide post to bias the guide plate assembly 14 away from the base plate, as shown in FIG. 1. As shown in the exploded view of FIG. 7, each guide post includes a threaded end 17 that is threaded into a nut on the opposite side of the lower mounting bosses 20 formed on the base plate 12. The upper end of the guide posts extend through a corresponding upper mounting boss 22 formed in the guide plate assembly 14. A pair of locking screws 23 engage a threaded opening (not shown) in the end of each guide post to firmly lock the guide posts between the base plate and guide plate assemblies. A washer 24 can be provided with each locking screw, wherein the washers act as a limit stop to prevent the guide plate assembly from sliding off the posts 16. With this arrangement, it is understood that the guide plate assembly can be pushed downward along the guide posts toward the base plate, and that the springs will push the guide plate back to its vertically offset position once the operator releases the guide plate assembly.

Figure 7:
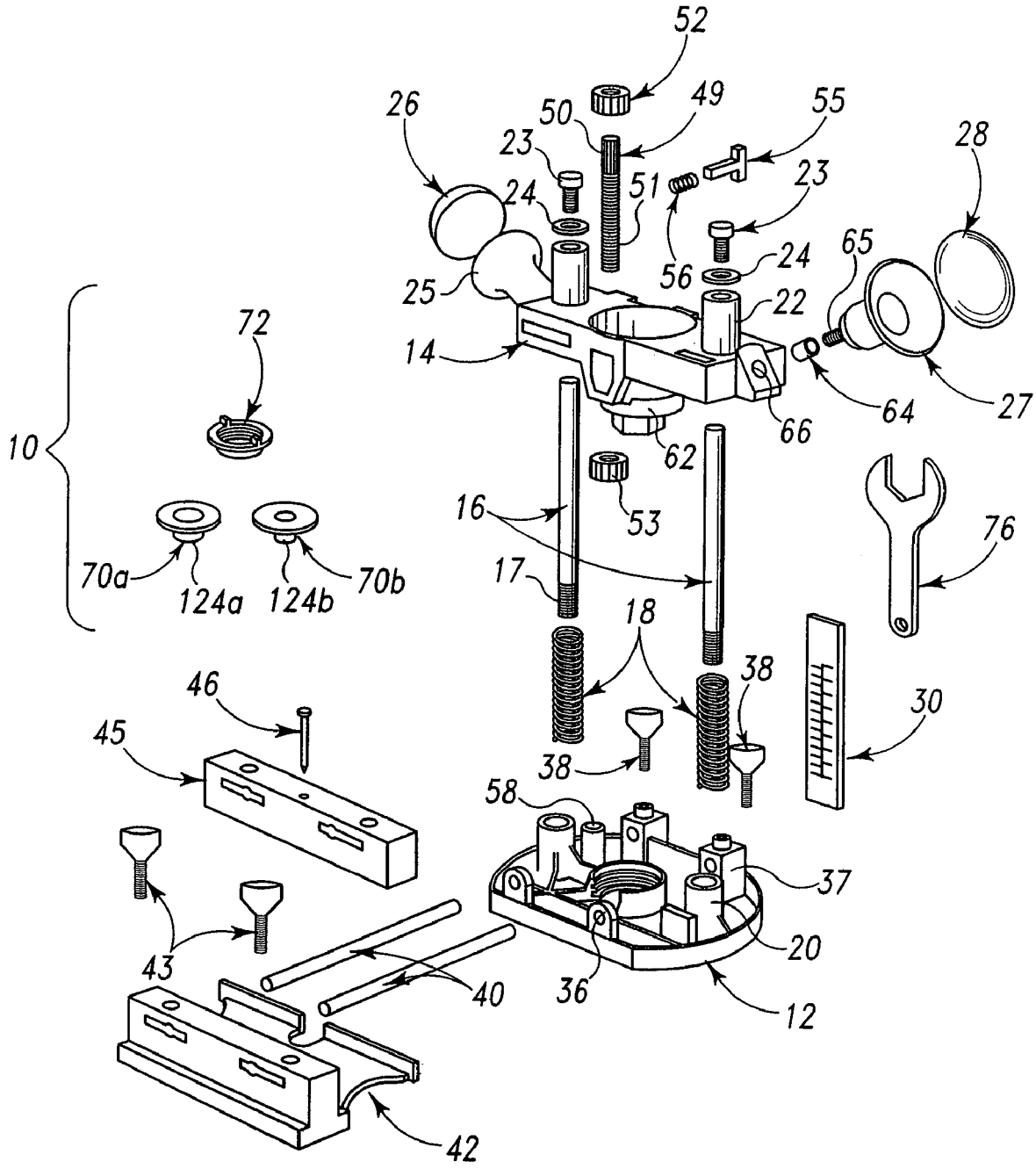
FIG. 7 is an exploded view of the power tool support fixture and interchangeable guides shown in FIG. 6.

To allow the user/operator to easily depress the guide plate assembly, and to control the movement of the support fixture 10, a pair of hand grips 25, 27 are provided. The hand grips can include a snap-on cap 26, 28, respectively, as shown in FIG. 7, to provide a rounded contour that is easily gripped by the operator. The hand grips 25, 27 are situated at opposite sides of the guide plate assembly 14, outboard of the guide posts 16 to ensure a smooth uniform downward movement of the guide plate assembly when depressed by the operator. In one feature of the inventive router support fixture 10, the right hand grip 27 includes a clamping screw end 65 (see FIGS. 2, 7 and 9) that threads into a bore 66 in the guide plate assembly that intersects the right guide post 16. A pressure spindle 64 is disposed between the screw end 65 and the guide post. As the clamping screw end 65 is threaded into the bore 66, the spindle 64 presses against the guide post 16 to clamp or lock the guide plate assembly 14 at a particular vertical position relative to the base plate 12. This clamping screw and pressure spindle feature allows the operator to adjust the depth of cut of the routing bit into the workpiece. For instance, varying depths of cuts may be needed to create a particular joint or surface pattern in a workpiece. The adjustment feature provided by the right hand grip 27 allows the operator to make these depth adjustments without removing the router and router support fixture from the workpiece.

To increase the accuracy of these depth adjustments, the support fixture 10 is provided with a depth marker 30 that is supported vertically from the base plate. The marker 30 is preferably removable and replaceable. In the preferred embodiment, the depth marker 30 is supported by a boss 31 formed in the base plate and a slot 32 in the guide plate assembly (so the guide plate assembly can slide relative to the marker 30). Preferably, the boss 31 forms a slight pressure fit with the depth marker 30 so that the marker cannot be easily dislodged.

The base plate 12 defines a guide edge 34 that integrates with certain guide components depicted in FIGS. 6 and 7. In particular, one guide component is an edge guide 42 that can be used to accurately space the router bit relative to the edge of the workpiece. The edge guide 42 is supported on the base plate by a pair of horizontally extending guide rods 40. Each guide rod passes through a guide rod support 36 in the front of the base plate 12 and through a guide rod clamp 37 at the back of the assembly. A clamping screw 38 fixes each guide rod 40 within a corresponding clamp 37 of the base plate. A pair of clamping screws 43 fix each guide rod within corresponding bores in the edge guide 42 to firmly hold the edge guide in relation to the support fixture 10.

Alternatively, the guide component can be a circle guide 45. The circle guide 45 is mounted to the support fixture 10 using the same guide rods 40 described above. The circle guide includes a centering bore 47 through which extends a nail 46 that is driven into the workpiece to establish the center point for rotation of the router support fixture 10.

Figure 3:
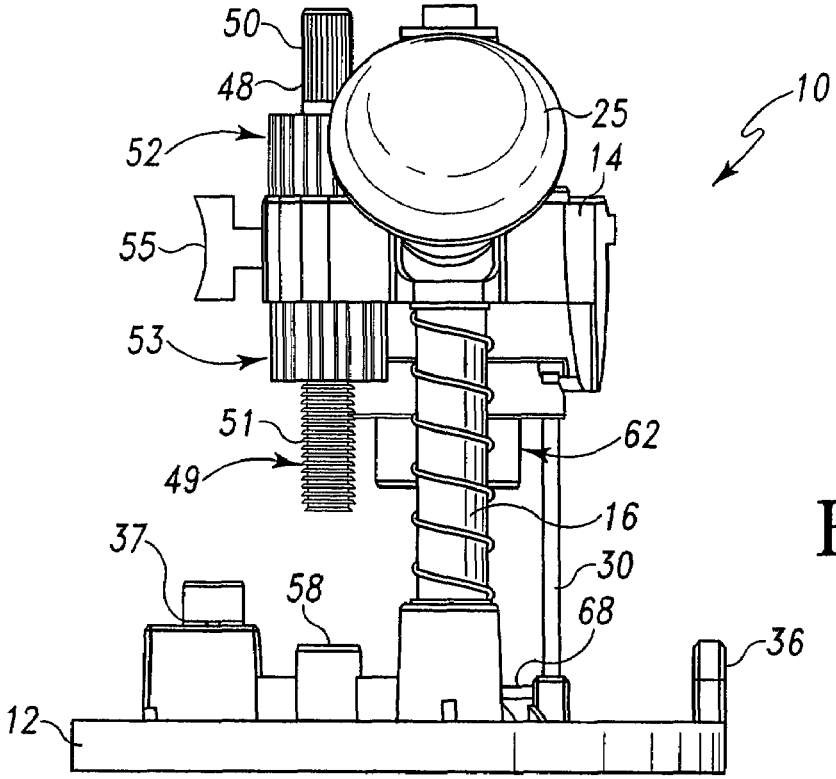
FIG. 3 is a left side elevational view of the power tool support fixture shown in FIG. 1.
Figure 4:
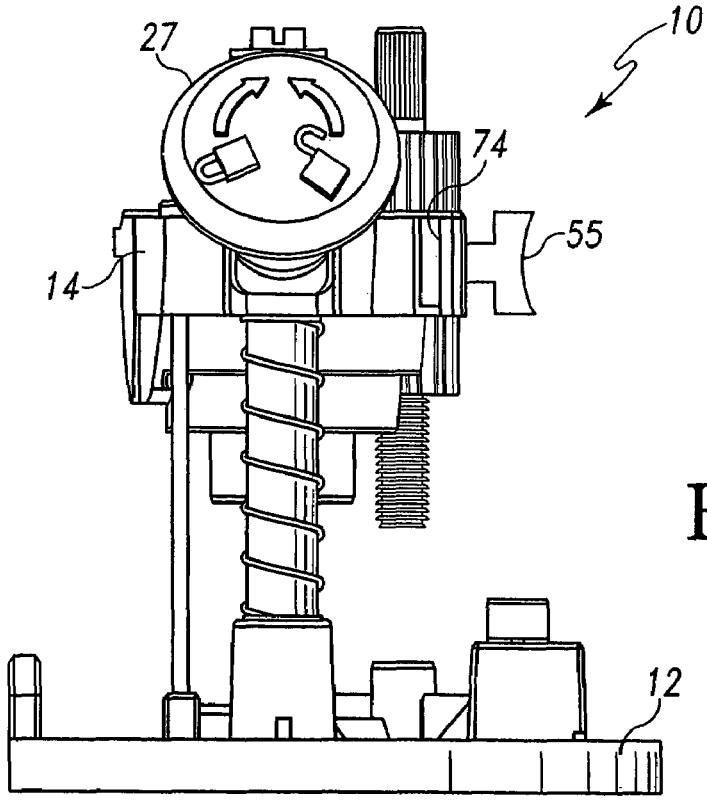
FIG. 4 is a right side elevational view of the power tool support fixture shown in FIG. 1.

In another aspect of the router support fixture 10 of the present invention, a limit stop assembly 48 is provided to limit the downward movement of the guide plate assembly 14. As best shown in FIGS. 3 and 7, the limit stop assembly 48 includes a thumb screw 49 having a threaded shank 51 and an upper knurled end 50. The knurled end 50 is configured to facilitate manual rotation of the thumb screw to adjust the limit stop assembly. An upper adjustment nut 52 and lower adjustment nut 53 are threaded onto the threaded shank 51 and sandwich the guide plate assembly. The lower end of the thumb screw contacts a limit stop 58 formed on the base plate when the guide plate assembly has been depressed by the operator, thereby limiting the depth that the router bit engages the workpiece. The upper and lower adjustment nuts 52, 53 essentially clamp the limit stop assembly 48 to the guide plate assembly, while allowing adjustment of the thumb screw 49 by simply rotating the knurled end 50. In one embodiment, a release button 55, biased by a spring 56, is engageable to the thumb screw 50 (see FIGS. 4 and 7) through a slot defined in the guide plate assembly. The release button 55 can prevent rotation of the thumb screw 50, and thereby prevent adjustment of the limit stop assembly, until the release button is depressed. It should be understood that the limit stop assembly 48 can be used in conjunction with the adjustment screw 65 and spindle 64 of the right hand grip 27 to hold the support fixture at the limit stop depth during operation of the router.

Preferably, the base plate 12 and the guide plate assembly 14 are formed substantially of a high strength plastic material. In addition, the tool support housing and guide bushing components are also preferably formed of a plastic material. The guide posts 16 are preferably formed of metal to improve wear resistance as the guide plate assembly translates up and down along the posts. In one embodiment of the invention, at least the base plate 12 is formed of a substantially transparent material. This transparent material will permit a generally unobstructed view of the working area as the power tool performs its cuts in the workpiece.

In one important feature of the invention, a tool support housing 60 is provided within the guide plate assembly 14 that is used to carry the operating end of the power tool when the tool is supported by the router support fixture 10. The tool support housing 60 includes a clamping mechanism for clamping the tool to the support housing. In a preferred embodiment, this clamping mechanism includes an engagement member in the form of an overthrow nut assembly 62 that can be used to readily engage the working end of the tool within the support housing 60, as described in more detail herein.

In a further important feature of the invention, a guide bushing collar 68 is defined in the base plate 12, as shown in FIG. 1. This guide bushing collar 68 carries components for guiding the router support fixture along a pattern or template, as described in more detail herein.

Yet another aspect of the invention contemplates means for mounting accessories to the router support fixture 10. In accordance with one embodiment, dovetail accessory mounts 74 are defined on the perimeter of the guide plate assembly 14, as best seen in FIGS. 1 and 5. These mounts 74 can mate with correspondingly configured dovetail elements associated with a variety of accessories for use with the router. Another accessory for the router support fixture 10 can include a wrench 76 that can be carried in a slot defined in the guide plate assembly, as shown in FIGS. 6 and 7. The wrench can be used to tighten or loosen the overthrow nut assembly 62, as described below.

Figure 8:
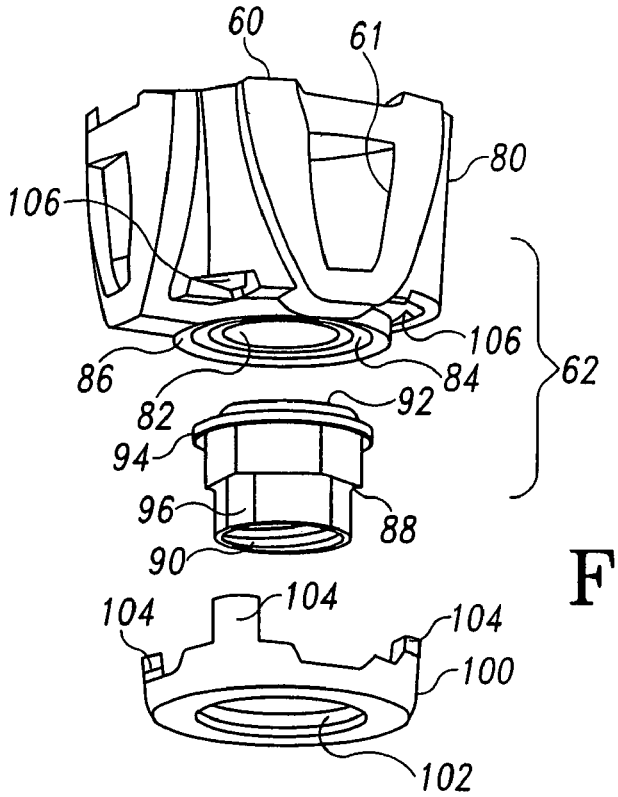
FIG. 8 is an exploded view of a tool support for use with the power tool support fixture of FIG. 1, in accordance with one embodiment of the invention.

Details of one embodiment of the overthrow nut assembly 62 can be seen in FIG. 8. In particular, the assembly 62 mates with the tool support housing 60 to provide means for clamping or mounting a hand-held power tool, such as the rotary tool R shown in FIG. 6, to the router support fixture. The housing includes a tool support body 80 that is configured to receive the working end of the tool R. A tool bore 82 allows extension of the working end through the housing 60. The working end of the tool can include a drive spindle S (see FIG. 14) with a tool bit mounted thereon. As is conventional in the art, the drive spindle S can be threaded to receive a collet nut N, as shown in FIG. 6. In one beneficial feature of the invention, the body 80 defines an access window 61 that allows access to the shaft lock button of certain hand-held power tools. Thus, the power tool R can be oriented so that its shaft lock button B is visible through the access window 61, as shown in FIG. 6.

The support body 80 defines a guide recess 84 concentric about the tool bore 82 on the underside of the body. The recess terminates in a bearing face 86 that is directly abutting an overthrow nut 88. The nut 88 includes a threaded tool bore 90 that is configured to mate with the threaded end of the housing of the tool R. Most hand-held tools include a threaded portion of the tool housing adjacent the drive spindle, such as the threaded portion T shown on the tool R in FIG. 14. Ordinarily, this threaded portion carries a housing cap which shields a portion of the collet nut N. In accordance with the present invention, the hand-held tool is mounted within the router support fixture (and more particularly the overthrow nut 88) by first removing the collet nut N of the tool R. The housing cap can then be removed and the collet nut N replaced. The tool can then be placed within the tool support housing 60 with the threaded portion of the tool R threaded into the threaded tool bore 90 of the overthrow nut 88.

As explained above, the tool R is oriented within the housing 60 so that the shaft lock button B of the tool R is accessible through the window 61. In this orientation, the bit of the tool R can be replaced while the tool is supported within the router support fixture 10. The operator can simply depress the shaft lock button B while loosening the collet nut of the tool R. The old bit can be removed and new bit inserted into the collet of the router tool R, with the assembly tightened by again accessing the shaft lock button B through the window 61.

The overthrow nut 88 includes a guide collar 92 at the top of the nut that is sized for rotating engagement within the guide recess 84 of the support body 80. A bearing flange 94, disposed beneath the guide collar 92, is sized for rotating engagement relative to the bearing face 86 of the support housing and the interior of a retainer cup 100 used to trap the bearing flange 94. The exterior of the nut 88 preferably defines wrench engagement surfaces 96, such as a hex head configuration. The wrench 76 described above is preferably configured to engage the hex surfaces 96 to tighten or loosen the overthrow nut 88. However, the engagement surfaces 96 are most preferably sized to accommodate manual rotation of the overthrow nut 88 to connect the router tool R to the support housing 60.

Figure 2:
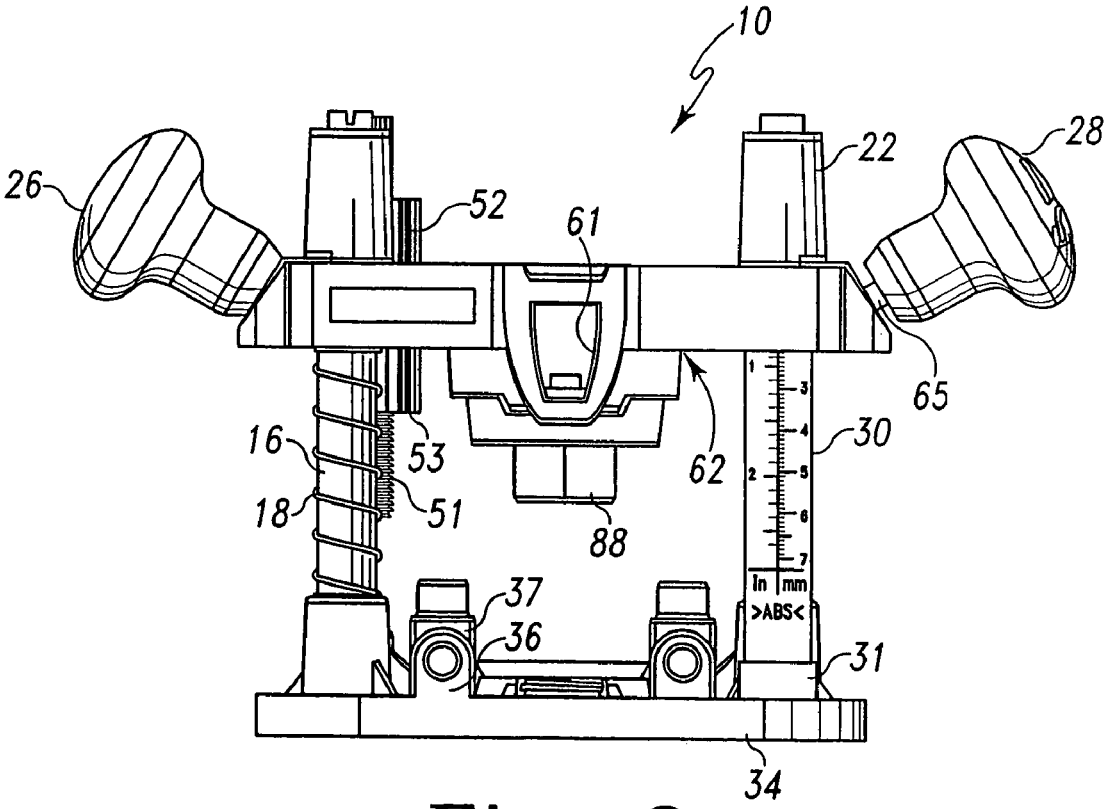
FIG. 2 is a front elevational view of the power tool support fixture shown in FIG. 1.

The overthrow nut assembly 62 is configured to allow free rotation of the overthrow nut 88. Thus, the assembly 62 includes a retainer cap 100 that interfaces with the support body 80 to trap the overthrow nut. The retainer cap 100 defines a bore 102 through which the overthrow nut 88 extends, as shown in FIG. 2. Preferably, the bearing flange 94 is trapped between the bearing face 86 of the support body 80 and the interior of the retainer cap 100 when the cap is mounted to the support body. In a preferred embodiment, the retainer cap includes at least two prongs 104 projecting upward from the cap. These prongs 104 extend through slots 106 defined in the support body 80. Preferably, the prongs are hot staked to the support body to permanently encase the overthrow nut 88. Alternatively, the prongs and slots can form a snap-fit interface or can be sonically welded to the body. As a further alternative, the retainer cap can be threaded onto a threaded boss on the underside of the support body 80.

Figure 9:
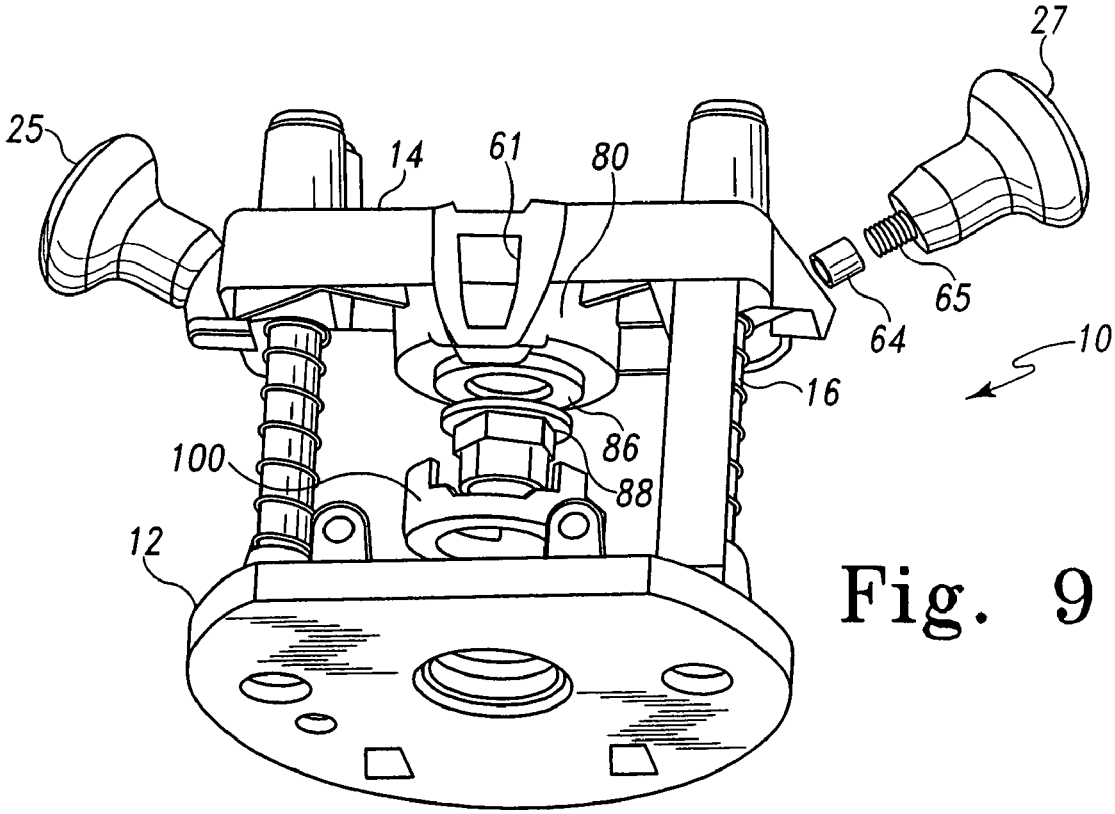
FIG. 9 is a bottom perspective view of the power tool support fixture shown in FIG. 1, with the tool support of FIG. 8 shown in exploded view prior to connection to the power tool support fixture.

The tool support housing 60 and overthrow nut assembly 62 is depicted in FIG. 8 as a separate component. In the preferred embodiment of the router support fixture 10, the tool support body 80 is integrally formed with the guide plate assembly 14, as shown in FIG. 9. The retainer cap 100 can be configured and attached to the integral body 80 as described above.

Figure 10:
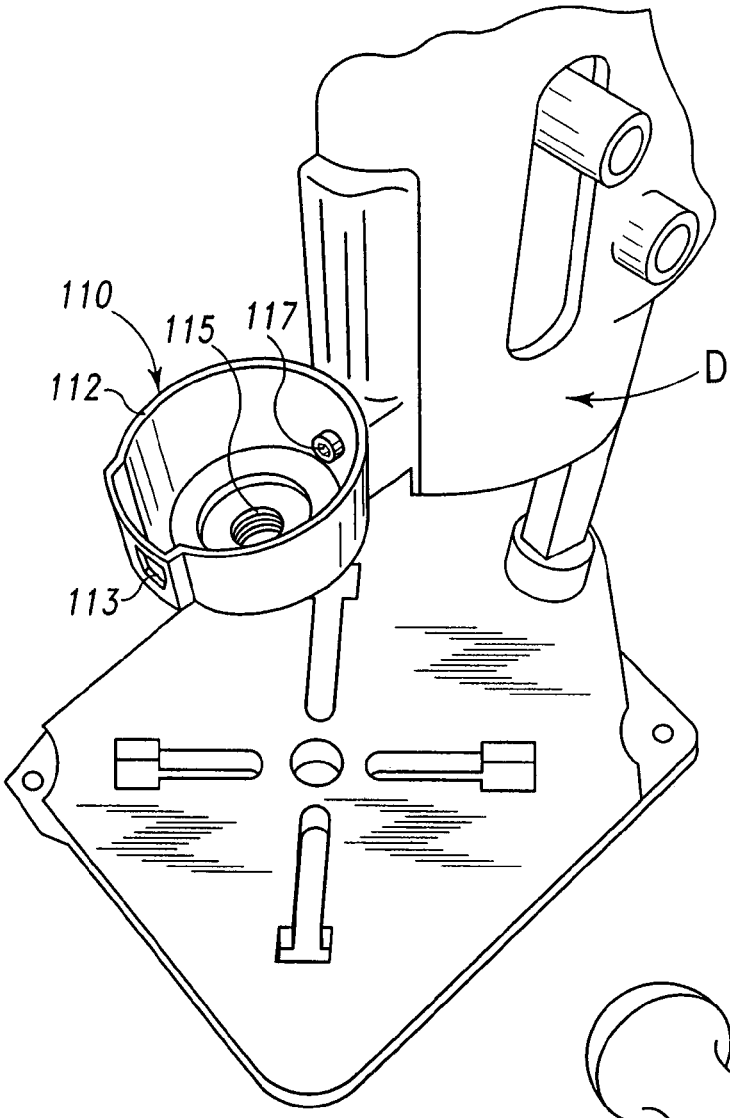
FIG. 10 is a top perspective view of a drill guide with the tool support of FIG. 8 connected thereto.

In another embodiment, the housing 60 is kept as a stand-alone component. Thus, as shown in FIG. 10, a tool support assembly 110 can include a tool support body 112 that is substantially identical to the body 80, including the provision of an access window 113 through which the shaft lock button B of the tool R can be accessed. The assembly 110 also includes an overthrow nut assembly 115 that is configured as described above. Since the tool support assembly 110 is an independent component, it can be mounted to a drill press D, for instance, by way of a fastener arrangement 117. The fastener arrangement can include machine screw passing through an opening in the body 113 and aligned with a mating opening on the drill press D. Thus, the tool support assembly 110 can be used to convert a hand-held power tool into a drill press arrangement to facilitate accurate alignment of holes drilled into a workpiece.

The overthrow nut assemblies 88 and 115 of the present invention provide a substantial advantage over prior tool attachments. In prior attachments, a clamp is used to clamp onto the body of the power tool. In plunger type tools, the power tool may not be clamped to the attachment, the attachment relying instead on gravity to hold the tool on the support. With the present invention, the hand-held power tool R can be easily connected to or disconnected from the router support fixture. The working end of the tool can be easily inserted into the support housing 60 with the threaded portion of the tool aligned with the overthrow nut 88. The tool is fixed to the support fixture by simply rotating the overthrow nut from beneath the guide plate assembly 14.

Figure 11:
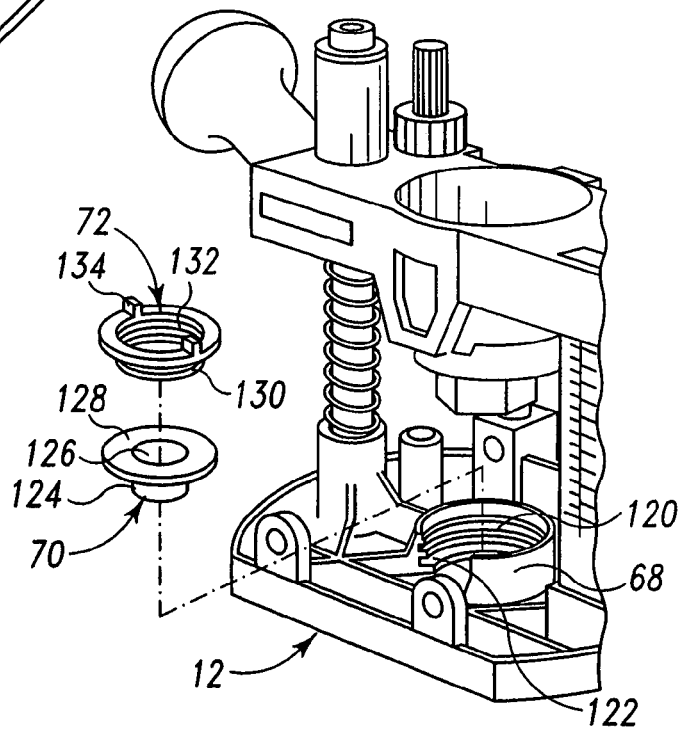
FIG. 11 is a front perspective view of the power tool support fixture shown in FIG. 1, with a guide bushing assembly shown in exploded view prior to connection to the power tool support fixture.

A further important feature of the invention resides in the guide bushing collar 68 and associated guide components. In particular, as shown in FIG. 11, the collar 68 defines internal threads 120 and a support ledge 122 at the base of the collar opening 69. A guide bushing 70 can be placed within the collar 68, resting on the support ledge 122. Specifically, the guide bushing 70 can include a template guide 124 that is sized to project beyond the bottom surface of the base plate and into a channel of the woodworking template. Thus, the vertical extent of the template guide 124 must be calibrated to extend sufficiently beyond the base plate, but not so far into the template itself that the template guide 124 contacts the workpiece underneath.

The guide bushing defines a bit bore 126 through which the tool bit extends. A support plate 128 is concentrically defined around the bit bore and is configured to rest on the support ledge 122 of the guide bushing collar 68. The guide bushing 70 is held in place by a bushing plug 72. In the preferred embodiment, the bushing plug 72 includes a threaded collar 130 that mates with the internal threads of the guide bushing collar 68. A pair of fingers 134 project upward from the plug 72 for manual engagement.

As shown in FIG. 7, the router support fixture 10 can be provided with a set of guide bushings 70*a*, 70*b*. As can be seen from the figure, the bushings 70*a*, 70*b* have differently sized template guides 120*a*, 120*b*, respectively. Specifically, the template guides 120*a*, 120*b* can be provided in different diameters depending upon the width of the channels of the template or pattern. Moreover, the template guides can have different vertical dimensions, again depending upon the thickness of the underlying template. The present invention allows for easy replacement of the guide bushing 70, even while the router support fixture 10 is situated on a workpiece. Specifically, the guide bushing is accessible from the top of the base plate. Prior guide arrangements required access to the bottom of the base plate, and in some cases both the top and bottom of the base plate. With either of these prior configurations, it was necessary to remove the router support fixture and manipulate the guide bushing apart from the workpiece. The present invention eliminates this cumbersome approach.

Figure 12:
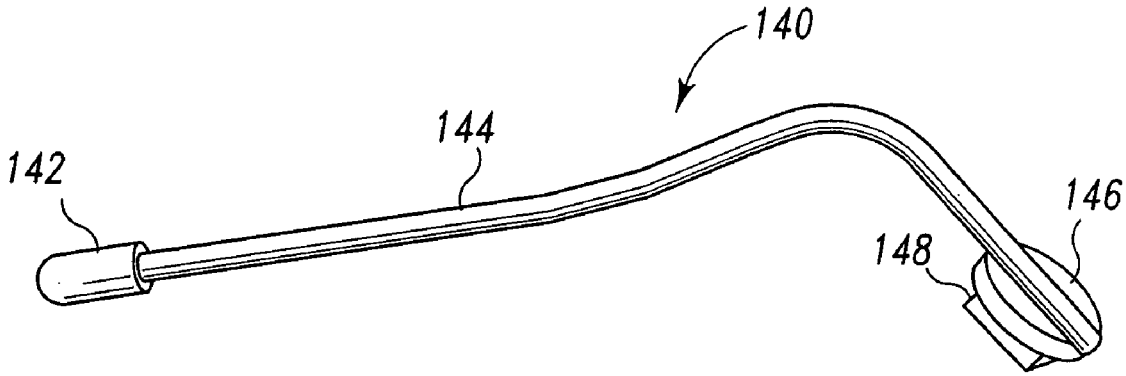
FIG. 12 is a perspective view of one embodiment of a utility accessory incorporating a light source for mounting to the power tool attachment shown in FIG. 1.
Figure 13:
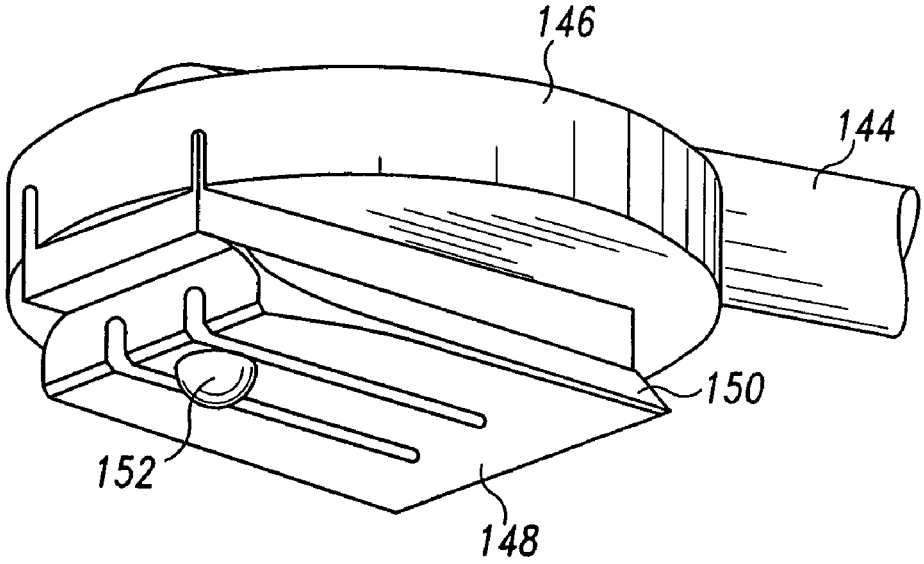
FIG. 13 is an enlarged view of one end of the utility accessory shown in FIG. 12, depicting the mounting component for mounting the utility attachment to the power tool attachment of FIG. 1.

As mentioned above, the guide plate assembly includes a number of dovetail mounts 74. These mounts are configured to support different accessories associated with the particular woodworking project. One such accessory is shown in FIGS. 12-13. The accessory 140 includes a light source 142 at one end of a flexible support 144. A stand-alone power supply 146 is provided at the opposite end of the flexible support. A mounting portion 148 is integrated at the opposite end of the support 144. As shown in detail in FIG. 13, this mounting portion 148 can define a dovetail edge 150 that is configured for a tight fitting engagement with the dovetail mounts 74 of the router support fixture 10. The mounting portion 148 of the accessory 140 can also include a pressure knob 152 projecting from the surface of the portion. This pressure knob is configured to reside within a dimple 75 defined in the dovetail mount 74, as shown in FIG. 5. The interface between the pressure knob 152 and the dimple 75 helps retain the engagement between the dovetail mount 74 and the dovetail edge 150 of the mounting portion 148. The pressure knob can be formed of a resilient material, or can be spring biased in a known manner.

In the preferred embodiment, the flexible support 144 is a flexible armored cable connecting the light source 142 to the power source 146. For instance, the flexible support can be in the form of a "gooseneck" cable or a wrapped cable of known design. The light source 142 is preferably an LED, while the power source is preferably a disc battery, such as a lithium ion or a NiCad battery. The power source 146 can include an "on/off" switch for energizing the light source.

The side disposed dovetail mounts are particularly well suited for support a light accessory, such as the accessory 140 shown in FIG. 12. Prior lighting systems for power tools are integrated into the working end of the tool, adjacent the output spindle. While such an arrangement may be suited for stand-alone operation of the power tool, it is far from ideal for usage in connection with a guiding support, such as the router support fixture 10 of the present invention, where the support fixture is closely disposed around the cut formed in the workpiece. The flexible cable feature of the accessory 140 of the present invention allows the light to be manipulated and positioned for optimum exposure to the working surface. Moreover, the provision of multiple dovetail mounts 74 means that more than one light source can be mounted to the router support fixture to bathe the working area in light.

Figure 14:
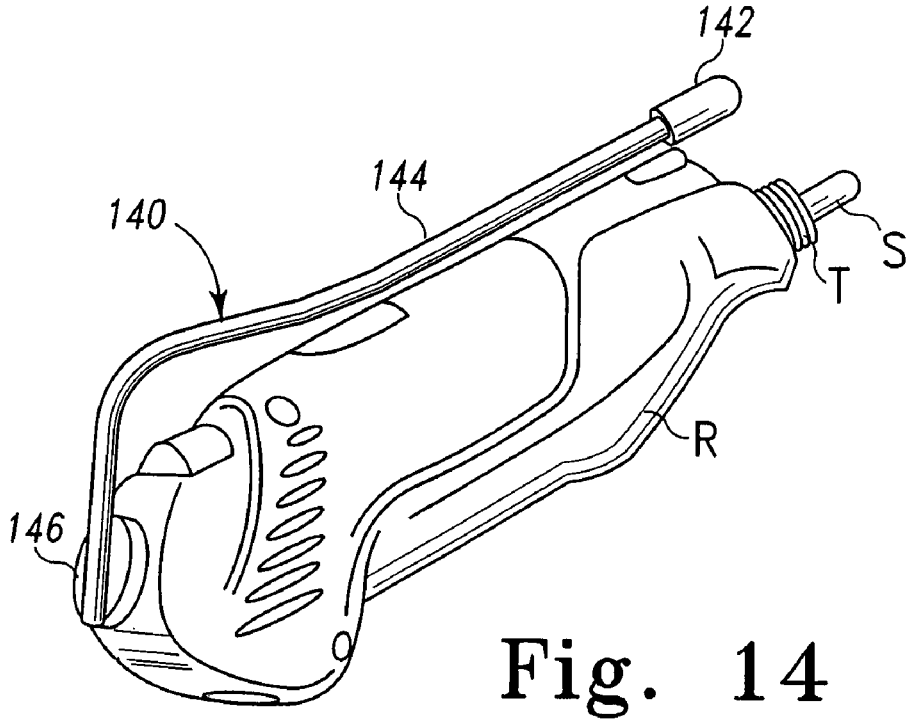
FIG. 14 is a perspective view of the utility accessory mounted to a hand-held power tool in one embodiment of the invention.
Figure 15:
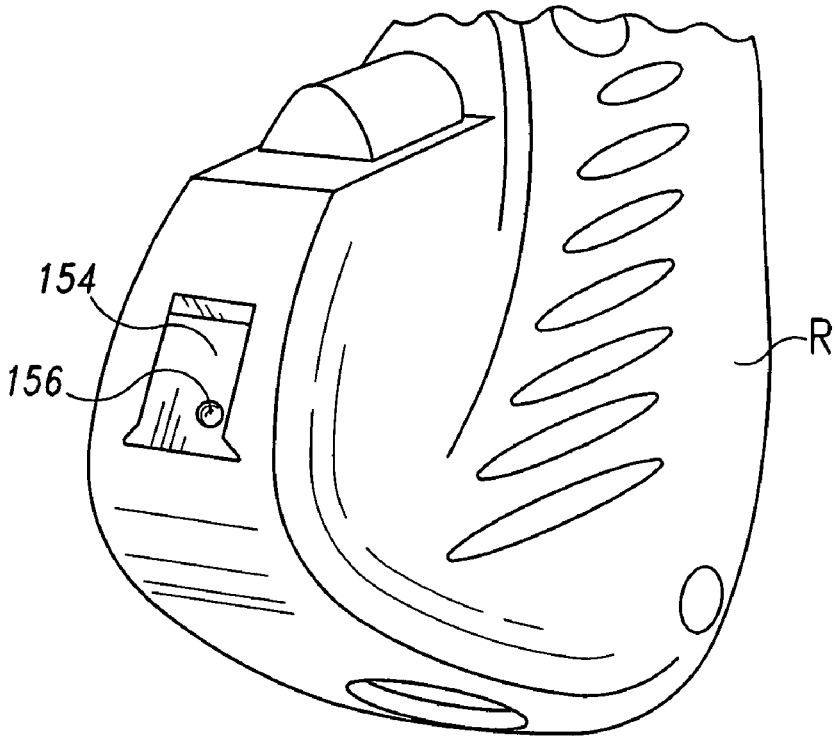
FIG. 15 is an enlarged view of one end of the hand-held power tool shown in FIG. 14, depicting the mating interface for mounting the utility accessory in the manner shown in FIG. 14.

Another benefit of the accessory 140 of the present invention will be appreciated with reference to FIGS. 14-15. Specifically, the accessory 140 is shown mounted to the hand-held power tool R. The mounting portion 146 can be engaged to a dovetail mount 154 defined in the end of the power tool R, as shown in FIG. 15. The mount 154 can include a dimple 156 to receive the pressure knob 152 (FIG. 13) of the mounting portion 146. Locating the dovetail mount 154 at the end of the tool R keeps the mount clear of the body of the tool that would be situated within a router support fixture 10. Moreover, this position for mounting the accessory 140 keeps the mount clear of where the use would grip the hand-held tool—i.e., free of the length of the tool body. The flexible cable or support 144 can be flexed to position the light source 142 where it is needed most. Moreover, the flexible cable can be configured as necessary to provide clearance around the tool body.

In the illustrated embodiment, the accessory 140 is a light source. Other types of accessories are contemplated provided they can be kept in a small and light enough package so as not to interfere with the use of the hand-held tool R and the router support fixture 10. Moreover, the accessory preferably is provided with its own power source, where necessary, to avoid the need for wires and plugs to connect to an external power source. For instance, the accessory can be configured as a directional source of air to help clear the working area of wood chips and dust. In this case, the light 142 at the free end of the accessory can be replaced with a nozzle, while the flexible support 144 can be in the form of a flexible conduit. The power supply 146 can include a fan, such as a piezo fan, capable of sufficient air flow to clear the working area of debris. Alternatively, the power supply can be replaced by a squeeze bulb that can be rapidly depressed to generate a burst of air at the free end of the accessory.

One benefit of the accessory 140 is exemplified by its ability to be mounted to the power tool itself. It is contemplated that mating dovetail mounts can be provided on various components in the woodworking workshop. For instance, the carrying case for the power tool can be provided with dovetail mounts on its exterior so that the carrying case and light accessory can be combined to form an independent light source.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected. For instance, while the illustrated tool R is a rotary power tool, other tools are contemplated.

Furthermore, while the support fixture 10 of the illustrated embodiment is configured for use in connection with a hand-held router, the support fixture can be used with other hand-held power tools. For instance, the same support fixture can be used as a drill press where the power tool R is a drill.

In the preferred embodiment, the overthrow nut assembly 62 is configured to engage a threaded portion T on the body of the power tool R. Thus, the assembly includes a nut 88 that is internally threaded to mate with the threaded portion of the tool. However, other engagement mechanisms are contemplated, provided they are capable of easy manual manipulation. For instance, a collet or similar clamping arrangement can be implemented in lieu of the overthrow nut.

Furthermore, in the preferred embodiment, the arrangement for mounting the accessories to the support fixture or to the body of the power tool contemplates a dovetail engagement. In an alternative embodiment, the dovetail engagement can be replaced by a suitable male-female mounting feature capable of a tight fit or press fit engagement.

What is claimed is:

1. An assembly, comprising:

a hand-held power tool including (i) a housing having an exterior threaded portion, and (ii) a drive spindle; and a support apparatus including:

a base;

a vertical support member connected to said base;

a carriage movable in relation to said vertical support member, said carriage having a receptacle that defines an upper opening and a lower opening, said hand-held power tool being received within said receptacle so that a first portion of said hand-held power tool extends through said lower opening and a second portion of said hand-held power tool extends through said upper opening; and a nut rotatably secured to said receptacle, said nut defining an internally threaded bore extending therethrough, and said internally threaded bore being positioned in alignment with said lower opening of said receptacle, and further said exterior threaded portion of said housing of said hand-held power tool being threadingly received within said internally threaded bore defined by said nut.

2. The assembly of claim 1, wherein:

said upper opening possesses a first diameter, said lower opening possesses a second diameter, and said second diameter is less than said first diameter.

3. The assembly of claim 1, wherein said nut includes an exterior polygonal drive surface.

4. The assembly of claim 1, wherein:

said receptacle includes a sidewall vertically disposed between said upper opening and said lower opening, and said sidewall has defined therein an access opening configured to allow a user's finger to extend threrethrough to contact a locking mechanism of the hand-held power tool.

5. The assembly of claim 1, wherein said support apparatus further includes a retainer member attached to said receptacle, wherein:

said retainer member defines a second bore aligned with said lower opening of said receptacle, said nut includes (i) a first portion interposed between said receptacle and said retainer member, and (ii) a second portion that extends through said second bore, and said second portion of said nut includes an exterior polygonal drive surface.

6. The assembly of claim 5, wherein:

said retainer member includes a plurality of arms, said receptacle includes a plurality of slots defined therein, and said plurality of arms respectively extend through said plurality of slots.

7. The assembly of claim 5, wherein:

said first portion of said nut includes a circumferential flange, and said circumferential flange is interposed between said receptacle and said retainer member.

8. The assembly of claim 1, wherein said support apparatus further includes:

a first hand grip attached to a first side of said carriage, and a second hand grip attached to a second side of said carriage that is opposite said first side of said carriage.

9. The assembly of claim 1, wherein:

said carriage is movable in relation to said vertical support member between an upper position and a lower position, and said carriage is spring biased toward said upper position.

10. The assembly of claim 1, wherein said support apparatus further includes a stop limit assembly attached to said carriage, wherein:

said stop limit assembly includes an elongate member having a lower end, said lower end of said elongate member is spaced apart from said base when said carriage is located in said upper position, and said lower end of said elongate member is positioned in contact with said base when said carriage is located in said lower position.

11. An assembly, comprising:

a hand-held power tool including (i) a housing having an exterior threaded portion, and (ii) a drive spindle; and a support apparatus including:

a base;

a vertical support member connected to said base;

a carriage movable in relation to said vertical support member, said carriage having a receptacle that defines an upper opening and a lower opening, said receptacle being configured to receive said hand-held power tool so that a first portion of said hand-held power tool extends through said lower opening and a second portion of said hand-held power tool extends through said upper opening; and an attachment member rotatably secured to said receptacle, said attachment member defining an internally threaded bore, and said internally threaded bore being (i) positioned in alignment with said lower opening of said receptacle, and (ii) positioned in mating relationship with said exterior threaded portion of said housing of said hand-held power tool.

12. The assembly of claim 11, wherein:

said receptacle includes a sidewall vertically disposed between said upper opening and said lower opening, and said sidewall has defined therein an access opening configured to allow a user's finger to extend threrethrough to contact a locking mechanism of the hand-held power tool.

13. The assembly of claim 11, wherein said support apparatus further includes a retainer member attached to said receptacle, wherein:

said retainer member defines a second bore, said attachment member includes (i) a first portion interposed between said receptacle and said retainer member, and (ii) a second portion that extends through said second bore, and said second portion of said attachment member includes an exterior polygonal drive surface.

14. The assembly of claim 13, wherein:

said retainer member includes a plurality of arms, said receptacle includes a plurality of slots defined therein, and said plurality of arms respectively extend through said plurality of slots.

15. The assembly of claim 13, wherein:

said first portion of said attachment member includes a circumferential flange, and said circumferential flange is interposed between said receptacle and said retainer member.

16. The assembly of claim 11, wherein:

said carriage is movable in relation to said vertical support member between a first position and a second position, and said carriage is spring biased toward said first position.

17. An assembly, comprising:

a base;

a vertical member connected to said base;

a carriage movable in relation to said vertical support member, said carriage having a receptacle that defines an upper opening and a lower opening;

a hand-held power tool having (i) a housing including a threaded exterior portion, and (ii) a drive spindle, said hand-held power tool being positioned within said receptacle so that a first portion of said hand-held power tool extends through said lower opening and a second portion hand-held power tool extends through said upper opening; and an attachment member rotatably secured to said receptacle, said attachment member having an internally threaded portion that defines a bore extending through said attachment member, said internally threaded portion being meshingly engaged with said threaded exterior portion of said hand-held power tool, wherein at least a part of said drive spindle is interposed between said carriage and said base when said internally threaded portion of said attachment member is meshingly engaged with said threaded exterior portion of said hand-held power tool.

18. The assembly of claim 17, wherein:

said hand-held power tool further has a bit locking mechanism, said receptacle includes a sidewall vertically disposed between said upper opening and said lower opening, and said sidewall has defined therein an access opening configured to allow a user's finger to extend threrethrough to contact said bit locking mechanism of said hand-held power tool.

19. The assembly of claim 17, further comprising a retainer member attached to said receptacle, wherein:

said retainer member defines a second bore, said attachment member includes (i) a first portion interposed between said receptacle and said retainer member, and (ii) a second portion that extends through said second bore, and said second portion of said attachment member includes an exterior polygonal drive surface.

20. The assembly of claim 19, wherein:

said retainer member includes a plurality of arms, said receptacle includes a plurality of slots defined therein, and said plurality of arms respectively extend through said plurality of slots.

21. The assembly of claim 19, wherein:

said first portion of said attachment member includes a circumferential flange, and said circumferential flange is interposed between said receptacle and said retainer member.

22. The assembly of claim 17, wherein:

said carriage is movable in relation to said vertical support member between an upper position and a lower position, and said carriage is spring biased toward said upper position.

* * * * *